US008996259B2

(12) United States Patent
Kaneko et al.

(10) Patent No.: US 8,996,259 B2
(45) Date of Patent: Mar. 31, 2015

(54) FORKLIFT ENGINE CONTROL DEVICE

(75) Inventors: Shinji Kaneko, Oyama (JP); Yoshitaka Onodera, Hiratsuka (JP); Jun Hashimoto, Chigasaki (JP); Hideyuki Hiraiwa, Tochigi (JP); Kazunori Nishimura, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/643,236

(22) PCT Filed: Jul. 28, 2011

(86) PCT No.: PCT/JP2011/067210
§ 371 (c)(1),
(2), (4) Date: Nov. 29, 2012

(87) PCT Pub. No.: WO2012/029462
PCT Pub. Date: Mar. 8, 2012

(65) Prior Publication Data

US 2013/0089399 A1 Apr. 11, 2013

(30) Foreign Application Priority Data

Aug. 31, 2010 (JP) ..... 2010-194796

(51) Int. Cl.
*B66F 9/075* (2006.01)
*B66F 9/22* (2006.01)
(Continued)

(52) U.S. Cl.
CPC ..... *B66F 9/075* (2013.01); *F02D 29/04* (2013.01); *F02D 41/021* (2013.01); *B66F 9/082* (2013.01); *B66F 9/205* (2013.01); *B66F 9/22* (2013.01); *F02D 31/009* (2013.01)
USPC ..... 701/50; 123/319; 123/350; 187/224; 187/277; 187/276; 180/338

(58) Field of Classification Search
None
See application file for complete search history.

(56) References Cited

U.S. PATENT DOCUMENTS 5,050,379 A * 9/1991 Nagai et al. ..... 60/368
5,481,875 A * 1/1996 Takamura et al. ..... 60/443
(Continued)

FOREIGN PATENT DOCUMENTS

JP A-05-086635 4/1993
JP A-2005-291078 10/2005
(Continued)

OTHER PUBLICATIONS

Mannesmann Rexroth. "Variable Displacement Pump A10VSO" Accessed via http://www.airlinehyd.com/pdfs/Hydraulic/RexrothBosch/Rexroth_PDF/Pumps%20and%20Motors/RA_92712.PDF on Jan. 9, 2014. Archived by archive.org on Aug. 11, 2010.*
(Continued)

*Primary Examiner* — John R Olszewski
*Assistant Examiner* — Jeffrey Boomer
(74) *Attorney, Agent, or Firm* — Oliff PLC

(57) ABSTRACT

An engine control device for a forklift that suppresses an increase in fuel consumption amount and noise by limiting an engine rotation speed when the forklift is driven without the need to increase the engine speed according to the accelerator operation even when the accelerator is depressed hard. Determining means in a controller determines whether all of the following conditions are satisfied: a neutral position of the traveling direction instructing means; a lift raising switch and first, second and third attachment switches are turned off. When all of the above conditions are satisfied, it is determined whether the forklift is driven in any of a plurality of states. An engine control means generates and outputs a control command to obtain the engine speed based on the accelerator pedal depression with the upper limit value of the engine speed set as an upper limit value of the engine speed.

17 Claims, 8 Drawing Sheets

(51) Int. Cl.

| | |
|---|---|
| ***B66F 9/08*** | (2006.01) |
| ***B66F 9/20*** | (2006.01) |
| ***F02D 41/02*** | (2006.01) |
| ***F02D 29/04*** | (2006.01) |
| ***F02D 31/00*** | (2006.01) |

(56) References Cited

U.S. PATENT DOCUMENTS

| | | | | |
|---|---|---|---|---|
| 6,277,050 | B1 * | 8/2001 | Nakagawa et al. | 477/112 |
| 2001/0030085 | A1 * | 10/2001 | Nagata et al. | 187/222 |
| 2006/0260877 | A1 * | 11/2006 | Ito et al. | 187/224 |

FOREIGN PATENT DOCUMENTS

| | | |
|---|---|---|
| JP | A-2010-071095 | 4/2010 |
| JP | A-2010-163946 | 7/2010 |

OTHER PUBLICATIONS

Oct. 18, 2011 International Search Report issued in Application No. PCT/JP2011/067210 (with English translation).

* cited by examiner

FORKLIFT ENGINE CONTROL DEVICE

TECHNICAL FIELD

The present invention relates to a forklift engine control device.

BACKGROUND ARTS

A forklift is provided with a travel device and a working machine. The travel device is driven by an engine. The working machine has the engine as a drive source and operates when a pressure oil discharged from a working machine hydraulic pump is supplied to a working machine hydraulic actuator via a control valve.

Here, the control valve comprises a lift control valve, a tilt control valve, and an attachment control valve. The working machine hydraulic actuator comprises a lift cylinder, a tilt cylinder, and an attachment cylinder.

The forklift is provided with working machine operating means for operating the working machine according to the operation. The working machine operating means is operated in the direction of raising the lift so that the lift cylinder of the working machine operates in the direction of raising the lift, and the working machine operating means is operated in the tilt operation direction so that the working machine operates in the tilt direction.

The forklift is provided with an engine control means. The engine control means controls the engine so as to have an engine rotation speed according to the accelerator pedal operation with the high idle rotation speed as an upper limit value.

A maximum supply flow rate supplied from the working machine hydraulic pump to the working machine hydraulic actuator is set to be a flow rate required to operate the lift cylinder at the maximum speed in the direction of raising the lift.

On the other hand, in the case where the tilt cylinder only is independently operated in the tilt direction, it is not necessary to discharge the maximum supply flow rate from the working machine hydraulic pump, and it is sufficient to have about 50% of the maximum supply capacity of the working machine hydraulic pump. That is, the tilt cylinder can be operated at the maximum speed in the tilt direction by about a half of the flow rate that is discharged when the lift cylinder is operated at the maximum speed in the direction of raising the lift.

Here, for the working machine hydraulic pump, there is used a fixed displacement type hydraulic pump or a variable displacement type hydraulic pump.

When the fixed displacement type hydraulic pump is used as the working machine hydraulic pump, the flow rate to supply to the working machine hydraulic actuator is determined according to an opening area of the control valve. Thus, the opening area of the tilt control valve is set to be smaller than the opening area of the lift control valve to supply a necessary flow rate to the tilt cylinder.

Meanwhile, when the variable displacement type hydraulic pump is used as the working machine hydraulic pump, it is general to control a capacity of the working machine hydraulic pump such that a pressure difference before and after the control valve becomes a constant value (constant differential pressure control). By this constant differential pressure control, the operating oil having a flow rate corresponding to the opening area of the control valve is supplied to the working machine hydraulic actuator without depending on the load of the working machine. Therefore, in the case where the tilt cylinder is operated in the tilt direction, constant forward-and-backward control is performed to decrease the capacity of the working machine hydraulic pump, and the tilt cylinder is supplied with a necessary flow rate.

As a patent reference related to the present invention, there is the following Patent Reference 1.

The following Patent Reference 1 discloses an invention that aims to limit the maximum speed at the time when an inching pedal is depressed and, when the inching pedal of a forklift having its engine as a drive source is depressed, limits the maximum rotation speed of the engine to a rotation speed lower than an allowable maximum rotation speed. And, Patent Reference 1 also discloses an invention that aims to prevent the forklift from causing collapse of cargo while driving and, when the lift cylinder pressure is under no load, limits the engine maximum rotation speed of the forklift having the engine as a drive source to a rotation speed lower than the allowable maximum rotation speed.

Patent Reference 1: Japanese Patent Application Laid-Open No. 2010-71095

DISCLOSURE OF THE INVENTION

Problems to be Solved by the Invention

Even when the working machine operating means is solely operated only in the tilt operation direction (at a single tilt operation), the operator might depress the accelerator pedal to a maximum level. The above operating state causes the following problems.

Case where working machine hydraulic pump is a fixed displacement type hydraulic pump.

Of the oil quantity supplied from the working machine hydraulic pump to the tilt control valve, about 50% is returned as an excess flow rate to a tank. But, at this moment, the pressure of the operating oil which is not supplied to the tilt cylinder by the tilt control valve is raised uselessly, resulting in an oil temperature increase, an engine power loss, and an increase in fuel consumption amount.

Case where working machine hydraulic pump is a variable displacement type hydraulic pump.

The flow rate discharged from the working machine hydraulic pump is controlled to a necessary amount by the constant differential pressure control, but matching occurs at a point where the pump capacity is small and the engine rotation speed is in a maximum range on an engine torque diagram, causing an increase in noise and fuel consumption amount. That is, FIG. 1 shows an engine torque diagram having an axis for engine rotation speed N and an axis for torque T.

In FIG. 1, L indicates an engine maximum torque line, and F1, F2 . . . Fi . . . indicate equal fuel consumption curves. The equal fuel consumption curves F1, F2 . . . Fi . . . indicate properties on the torque diagram that the fuel consumption amount of the engine 13 becomes equal according to the engine rotation speed N and the engine torque T, each showing a fuel consumption amount per time. The fuel consumption amount increases in order of F1<F2< . . . <Fi . . . .

When the accelerator pedal is depressed to a maximum level at the time of the single tilt operation, the absorption torque of the working machine hydraulic pump and the working machine load match mutually at a point P2 where the pump capacity is small and the engine rotation speed reaches a maximum range (high idle rotation speed NH). This matching point P2 is a point where the fuel consumption amount is large in view of the equal fuel consumption curve, and noise is large because the engine rotation speed N is in the maximum range (high idle rotation speed NH).

The case of the single tilt operation was described above, but in addition to the single tilt operation, there is another operation state that provokes an increase in fuel consumption amount and noise when the accelerator pedal is depressed deeply.

The present invention has been made in view of the above circumstances and aims to suppress the increase in fuel consumption amount and noise by limiting the engine rotation speed in the case where it is determined to be a state that, even when the accelerator is depressed deeply, it is unnecessary to increase the engine rotation speed according to the accelerator operation.

The prior art document does not disclose an invention that aims to suppress an increase in fuel consumption amount and noise by limiting the engine rotation speed when it is determined to be a state that, even when the accelerator is depressed deeply, it is unnecessary to increase the engine rotation speed according to the accelerator operation in the forklift having the engine as the drive source.

Means for Solving the Problem

A first invention is an engine control device for a forklift, which is provided with a travel device driven by an engine and a working machine operated by receiving supply of a pressure oil discharged from a working machine hydraulic pump with the engine used as a drive source, and also provided with working machine operating means for operating the working machine according to operation, the working machine being operated in a direction of raising a lift by operating the working machine operating means in a direction of raising the lift and being operated in a tilt direction by operating the working machine operating means in a tilt operation direction, and engine control means for controlling the engine to have an engine rotation speed according to the operation of an accelerator with a high idle rotation speed as an upper limit value, the engine control device comprising:

vehicle body stop detecting means for detecting for detecting that the vehicle body is stopped;

working machine operation state detecting means for detecting an operation state of the working machine operating means;

determining means for determining on the basis of the detection result by the vehicle body stop detecting means and the detection result by the working machine operation state detecting means that the vehicle body is stopped and the working machine is not operated, the vehicle body is stopped and the working machine is solely operated only in the direction of lowering the lift, or the vehicle body is stopped and the working machine is solely operated only in the tilt direction; and engine rotation speed upper limit value setting means for setting an upper limit value of the engine rotation speed to a rotation speed lower than the high idle rotation speed when it is determined by the determining means that the vehicle body is stopped and the working machine is not operated, the vehicle body is stopped and the working machine is solely operated only in the direction of lowering the lift, or the vehicle body is stopped and the working machine is solely operated only in the tilt direction, wherein:

the engine control means controls the engine to have the engine rotation speed according to the operation of the accelerator with the engine rotation speed, which is set by the engine rotation speed upper limit value setting means as an upper limit value.

A second invention according to the first invention, wherein:

when it is determined by the determining means that the vehicle body is stopped and the working machine is solely operated only in the tilt direction, the engine rotation speed upper limit value setting means determines an upper limit value of the engine rotation speed to be an engine rotation speed at which an oil quantity supplied to the working machine becomes an oil quantity required for the tilt operation of the working machine.

A third invention according to the first invention or the second invention, wherein:

the working machine hydraulic pump is a variable displacement type hydraulic pump, the pressure oil is supplied from the working machine hydraulic pump to the working machine via a tilt control valve so that the working machine performs a tilt operation, and the capacity of the working machine hydraulic pump is controlled so that a pressure difference before and after the tilt control valve becomes a constant value.

A fourth invention according to the first invention, the second invention or the third invention, wherein the vehicle body stop detecting means is means for detecting that the vehicle body is stopped because a traveling direction indicating means for indicating a traveling direction of the vehicle body according to the operation is positioned in a neutral position.

A fifth invention according to the first invention, the second invention, the third invention or the fourth invention, wherein:

the working machine operating means comprises a lift operating means for operating the working machine in the direction of raising the lift, a tilt operating means for operating the working machine in the tilt direction, and an attachment operating means for operating the working machine in a direction according to an attachment;

the working machine operation state detecting means detects that the lift operating means is not operated in the direction of raising the lift and the attachment operating means is not operated, and when it is detected by the vehicle body detecting means that the vehicle body is stopped, and when it is detected by the working machine operation state detecting means that the lift operating means is not operated in the direction of raising the lift, and that the attachment operating means is not operated, the determining means determines that the vehicle body is stopped and the working machine is not operated, the vehicle body is stopped and the working machine is solely operated only in the direction of lowering the lift, or the vehicle body is stopped and the working machine is solely operated only in the tilt direction.

Effects of the Invention

According to the present invention, when it is determined to be that the operation is not in a state in which it is not unnecessary to increase the engine rotation speed according to the accelerator operation, such as:

a) a state that the vehicle body is stopped and the working machine is not operated,
b) a state that the vehicle body is stopped and the working machine is solely operated only in the direction of lowering the lift, or
c) a state that the vehicle body is stopped and the working machine is solely operated only in the tilt direction, the upper limit value of the engine rotation speed is set to a rotation speed lower than a high idle rotation speed, the set engine rotation speed is determined as an upper limit value, and the engine is controlled to have an engine rotation speed according to the accelerator operation with the set engine rotation speed as an upper limit value. Thus, an increase in fuel consumption amount and noise is suppressed.

BEST MODE FOR CARRYING OUT THE INVENTION

Embodiments of an engine control device for a forklift according to the present invention are described below with reference to the drawings.

FIG. 2 is a side view of a vehicle body 3 of a forklift 1, FIG. 2 shows a structure of a working machine 2 of the forklift 1.

As shown in FIG. 2, a mast 4 and a fork 5 are disposed as the working machine 2 at the front of the vehicle body 3 of the forklift 1. The mast 4 is supported by the vehicle body 3 via a pair of right and left tilt cylinders 8.

At a driver seat, there are provided working machine operating means 6, traveling direction instructing means 13, an accelerator pedal 25, and a brake pedal (inching pedal) 26. The working machine operating means 6 and the traveling direction instructing means 13 are comprised of, for example, operating levers.

The traveling direction indicating means 13 indicates a travelling direction of the vehicle body 3 according to the operation, namely a forward direction F or a reverse direction R.

According to the operation of the working machine operating means 6, the working machine 2 is driven to tilt the mast 4 and to lift the fork 5 so that the position and posture of a cargo placed on the fork 5 can be changed to a desired position and posture.

FIG. 3 shows a structure of the power transmission system of the forklift 1 of an embodiment.

The forklift 1 is provided with a travel device 7 and the working machine 2. The travel device 7 is driven by an engine 8. Using the engine 8 as the drive source, the working machine 2 is operated by supplying the pressure oil discharged from a working machine hydraulic pump 9 to a working machine hydraulic actuator 11 via a control valve 10.

Here, the control valve 10 comprises a lift control valve 10A, a tilt control valve 10B, a first attachment control valve 10C, a second attachment control valve 10D, and a third attachment control valve 10E. The working machine hydraulic actuator 11 comprises a lift cylinder 11A, a tilt cylinder 11B, a first attachment cylinder 11C, a second attachment cylinder 11D, and a third attachment cylinder 11E.

The attachment includes, for example, a roll clamp, a bail clamp, a guide shift, a fork mover, and a rotation fork, etc. The attachment cylinders 11C, 11D and 11E are operated so that right and left movements of the fork 5, and movements of the clamp and the rotation clamp can be made in addition to the lift movement and the tilt movement.

The forklift 1 is provided with the working machine operating means 6 for operating the working machine 2 according to the operation. The working machine operating means 6 comprises lift operating means GA which operates the lift cylinder 11A in the direction of raising the lift, tilt operating means 6B which operates the tilt cylinder 11B in a forward tilting direction or a backward tilting direction, and first attachment operating means GC, second attachment operating means 6D and third attachment operating means 6E which operate the first attachment cylinder 11C, the second attachment cylinder 11D, and the third attachment cylinder 11E in a direction A or a direction B according to the respective attachments.

The drive force of the engine 8 is transmitted to the working machine hydraulic pump 9 and an HST hydraulic pump 16 through a PTO shaft 14. The power transmission system from the HST hydraulic pump 16 to drive wheels 24 configures the travel device 7.

A hydrostatic transmission (HST—Hydro-Static Transmission) 17 comprises the HST hydraulic pump 16, an HST hydraulic motor 18, and an oil passage 19 which communicates respective ports 16*a* and 16*b* of the HST hydraulic pump 16 with respective flow-in and -out openings 18*a* and 18*b* of the HST hydraulic motor 18. The vehicle body 3 is moved forward or backward by switching the ports on the discharge side of the HST hydraulic pump 16. For example, when the pressure oil is discharged from the one port 16*a* of the HST hydraulic pump 16, the vehicle body 3 is moved forward, and when the pressure oil is discharged from the other port 16*b* of the HST hydraulic pump 16, the vehicle body 3 is moved backward. And, respective tilt angles of a swash plate 16*c* of the HST hydraulic pump 16 and a swash plate 18*c* of the HST hydraulic motor 18 are adjusted to change the respective capacities, thereby changing the speed.

The drive force of the HST hydraulic motor 18 is transmitted to an axle 21 via a differential gear 20. The axle 21 is provided with a braking device 22 and a final gear 23. The output axis of the final gear 23 is coupled with the drive wheels 24, Therefore, when the engine 8 is operating, the accelerator pedal 25 is depressed, and the traveling direction instructing means 13 is operated in the forward direction F or the reverse direction R, the drive wheels 24 are rotationally driven to travel forward or backward.

When the lift operating means 6A is operated in the direction of raising the lift, the pressure oil discharged through a discharge port 9*a* of the working machine hydraulic pump 9 is supplied to the lift cylinder 11A via the lift control valve 10A. Thus, the lift cylinder 11A is operated to raise the fork 5. And, when the lift operating means 6A is operated in the direction of lowering the lift, the pressure oil in the lift cylinder 11A is released into a tank 43. Thus, the fork 5 lowers under its own weight. When the lift operating means GA is positioned in a neutral position, the opening of the lift control valve 10A is closed, and supply and discharge of the pressure oil to and from the lift cylinder 11A are stopped. Thus, the height of the fork 5 is maintained.

When the tilt operating means 6B is operated in a forward tilting direction or a backward tilting direction, the pressure oil discharged through the discharge port 9*a* of the working machine hydraulic pump 9 is supplied to the tilt cylinder 11B via the tilt control valve 10B. Thus, the tilt cylinder 11B is operated in the forward tilting direction or the backward tilting direction, and the mast 4 is operated in the forward tilting direction or the backward tilting direction.

When the first attachment operating means 6C is operated in an operation direction A or B, the pressure oil discharged through the discharge port 9*a* of the working machine hydraulic pump 9 is supplied to the first attachment cylinder 11C via the first attachment control valve 10C. Thus, the first attachment cylinder 11C is operated in the direction A or B, and the attachment operates in the direction according to the attachment. Similarly, when the second attachment operating means 6D is operated in the operation direction A or B, the second attachment cylinder 11D is operated in the direction A or B via the second attachment control valve 10D, and when the third attachment operating means GE is operated in the operation direction A or B, the third attachment cylinder 11E is operated in the direction A or B via the third attachment control valve 10E.

When the traveling direction indicating means 13 is operated to indicate the forward direction F, the pressure oil is discharged from the port 16*a* of the HST hydraulic pump 16, and the vehicle body 3 moves forward. And, when the traveling direction indicating means 13 is operated to indicate the reverse direction R, the pressure oil is discharged from the port 16*b* of the HST hydraulic pump 16, and the vehicle body 3 moves backward.

When the brake pedal (inching pedal) 26 is depressed, the swash plate 16*c* of the HST hydraulic pump 16 is adjusted according to the depressed amount, the absorption torque of the HST hydraulic pump 16 decreases, and a braking force generated by the braking device 22 increases. Therefore, the larger the depressed amount of the brake pedal (inching pedal) 26 becomes, the drive force transmitted from the engine 8 to the drive wheels 24 is decreased, the braking force generated by the braking device 22 is increased, and the vehicle body 3 can be put in a stopped state.

The working machine hydraulic pump 9 is a variable displacement type hydraulic pump. In this embodiment, constant differential pressure control is performed. The tilt control valve 10B is explained as an example. A swash plate 9*c* of the working machine hydraulic pump 9 is adjusted to control the capacity of the working machine hydraulic pump 9 such that a pressure difference before and after the tilt control valve 10B becomes a constant value.

FIG. 4 shows a structure of the control system of the forklift 1.

The traveling direction instructing means 13 is provided with an FR switch 27 for detecting that the traveling direction indicating means 13 indicates the forward direction F or the reverse direction R or it is positioned in a neutral position N. The detection signal of the FR switch 27 is input to a controller 30.

The lift operating means 6A is provided with a lift raising switch 28 which outputs an on signal indicating that the operation was made in the direction of raising the lift. FIG. 5A shows the detection signal output from the lift raising switch 28. When the lift operating means 6A is not operated in the direction of raising the lift, namely when the lift operating means 6A is in the neutral position or operated in the lift lowering direction, it becomes off. The detection signal of the lift raising switch 28 is input to the controller 30.

The tilt operating means 6B is provided with a forward and backward tilt switch 29 which outputs as an on signal indicating that the operation tilt operating means 6B was operated to the forward tilting direction or the backward tilting direction. FIG. 5B shows a detection signal output from the forward and backward tilt switch 29. The detection signal of the forward and backward tilt switch 29 is input to the controller 30.

The first attachment operating means 6C is provided with a first attachment switch 31 which outputs as an on signal indicating that operation was made in the direction A or B. The detection signal of the first attachment switch 31 is input to the controller 30. Similarly, the second attachment operating means 6D is provided with a second attachment switch 32, the detection signal of the second attachment switch 32 is input to the controller 30, the third attachment operating means 6E is provided with a third attachment switch 33, and the detection signal of the third attachment switch 32 is input to the controller 30. FIG. 5C shows detection signals output from the first, second and third attachment switches 31, 32 and 33. When the first, second and third attachment operating means GC, GD and GE are not operated in the direction A or B, namely when the first, second and third attachment operating means 6C, 6D and GE are operated to a neutral position, the signals become off.

The accelerator pedal 25 is provided with accelerator detecting means 34 to detect a depressed amount. The accelerator detecting means 34 is comprised of for example, a potentiometer. The detection signal of the accelerator detecting means 34 is input to the controller 30.

The brake pedal (inching pedal) 26 is provided with braking detecting means 35 to detect a depressed amount. The braking detecting means 35 is comprised of, for example, a potentiometer, The detection signal of the braking detecting means 35 is input to the controller 30.

The controller 30 is provided with a vehicle body stop detecting means 36, a working machine operation state detecting means 37, a determining means 38, an engine rotation speed upper limit value setting means 39, and an engine control means 40.

The vehicle body stop detecting means 36 detects that the vehicle body 3 is stopped. The vehicle body stop detecting means 36 detects based on the detection signal of the FR switch 27 that the traveling direction instructing means 13 is positioned in the neutral position N.

The working machine operation state detecting means 37 detects an operating state of the working machine operating means 6. The working machine operation state detecting means 37 detects based on the detection signal of the lift raising switch 28 and the detection signals of the first, second and third attachment switches 31, 32 and 33 that the lift operating means 6A is not operated in the direction of raising the lift, and also detects that the first, second and third attachment operating means 6C, 6D and GE are not operated.

The determining means 38 determines based on the detected result of the vehicle body stop detecting means 36 and the detected result of the working machine operation state detecting means 37 that the vehicle body 3 is stopped and the working machine 2 is not operated, the vehicle body 3 is stopped and the working machine 2 is solely operated only in the lift lowering direction, or the vehicle body 3 is stopped and the working machine 2 is solely operated only in the tilt direction.

That is, the determining means 38 determines that the operation state is in one of the following states 1), 2) and 3) on conditions that all of the following conditions a), b) and c) are satisfied.

a) Traveling direction indicating means 13 is in a neutral position N, b) the lift raising switch 28 is off (the lift operating means 6A is not operated in the direction of raising the lift), and c) the first, second and third attachment switches 31, 32 and 33 are off (the first, second and third attachment operating means 6C, 6D and 6E are not operated), and 1) a state that the vehicle body 3 is stopped and the working machine 2 is not operated, 2) a state that the vehicle body 3 is stopped and the working machine 2 is solely operated only in the direction of lowering the lift, and 3) a state that the vehicle body 3 is stopped and the working machine 2 is solely operated only in the tilt direction.

When it is determined by the determining means 38 that the operation state is in one of the above states 1), 2) and 3), the engine rotation speed upper limit value setting means 39 sets the upper limit value of the engine rotation speed N to an engine rotation speed upper limit value NLIM which is a rotation speed lower than the high idle rotation speed NH. This engine rotation speed upper limit value NLIM is determined to be an engine rotation speed at which the oil quantity supplied to the working machine 2 becomes an oil quantity QL required for the tilt operation of the working machine 2.

The engine 8 is controlled by the engine control means 40, a governor 41 and a fuel injection pump 42.

The engine control means 40 limits the engine output torque to not more than the maximum torque value defined by the maximum torque curve L, generates a control command to obtain the engine rotation speed N corresponding to the depressed amount of the accelerator pedal 25 with the high idle rotation speed NH or the engine rotation speed upper limit value NLIM which is set by the engine rotation speed upper limit value setting means 39 as a rotation speed upper limit value, and outputs it to the governor 35 (see FIG. 7).

FIG. 6 shows a relationship between the depressed amount of the accelerator pedal 25 and the engine rotation speed N.

The engine control means 40 generates and outputs a control command to increase the engine rotation speed N as the depressed amount of the accelerator pedal 25 becomes larger. A minimum of the engine rotation speed N is determined to be a low-idle rotation speed NL. A maximum of the engine rotation speed N is determined to be the high idle rotation speed NH when the engine rotation speed upper limit value NLIM is not set by the engine rotation speed upper limit value setting means 39, and when the engine rotation speed upper limit value NLIM is set by the engine rotation speed upper limit value setting means 39, it is limited to the engine rotation speed upper limit value NLIM lower than the high idle rotation speed NH.

The governor 41 generates a fuel injection amount command that causes the engine rotation speed to be the engine rotation speed N given as the control command and limits to limit the engine output torque T to not more than the maximum torque value defined by the maximum torque line L, and outputs it to the fuel injection pump 42. The fuel injection pump 42 injects the fuel to the engine 8 so that the fuel injection amount given as the fuel injection amount command can be obtained.

The governor 41 is an all speed control type governor, and mechanical or electronic control is performed.

FIG. 7 shows an engine torque diagram. Regulation lines LL . . . LLIM . . . Li . . . LH are determined for respective engine rotation speeds N, namely for respective accelerator openings. When the accelerator opening (engine rotation speed Ni) is determined, the matching point between the pump absorption torque and the load moves along a corresponding regulation line Li while the engine rotation speed N decreases depending on the size of the load.

(First Control)

Control performed by the controller 30 is described below with reference to the flow chart of FIG. 9.

The determining means 38 in the controller 30 determines whether or not all of the above-described conditions are satisfied as follows:

a) the traveling direction instructing means 13 is in a neutral position N, b) the lift raising switch 28 is off (the lift operating means 6A is not operated in the direction of raising the lift), and c) the first, second and third attachment switches 31, 32 and 33 are off (the first, second and third attachment operating means 6C, 6D and 6E are not operated) (step 101).

When at least one of the conditions a), b) and c) is not satisfied (determined "Condition not satisfied" in step 101), it is determined that the operation state does not need to limit the engine rotation speed N to the engine rotation speed upper limit value NUM. The engine control means 40 limits the engine output torque to not more than the maximum torque value defined by the maximum torque line L, generates a control command to obtain the engine rotation speed N corresponding to the depressed amount of the accelerator pedal 25 with the high idle rotation speed NH as the rotation speed upper limit value, and outputs it to the governor 35.

Therefore, for example, when the operator depresses the accelerator pedal 25 to the maximum opening and performs a full stroke operation of the lift operating means 6A in the direction of raising the lift, matching occurs at the point P0 (rated point) on the regulation line LH corresponding to the high idle rotation speed NH in FIG. 7, and a heavy cargo can be lifted by the fork 5 at the maximum speed.

This matching point P0 is a point where, as a result of performing the constant differential pressure control, the swash plate 9*c* of the working machine hydraulic pump 9 is adjusted and a capacity q of the working machine hydraulic pump 9 is controlled to a capacity q0.

At this time, a flow rate QL of an operating oil discharged from the working machine hydraulic pump 9 and supplied to the lift cylinder 11A via the lift control valve 10A is expressed by the following.

$$QL=q0\times NH \quad (1)$$

In FIG. 8, LN1 shows a relationship between an operation amount of the lift operating means 6A and a flow rate Q of the operating oil discharged from the working machine hydraulic pump 9 and supplied to the lift cylinder 11A via the lift control valve 10A. When the lift operating means 6A is operated for a full stroke, the flow rate QL shown in the above equation (1) is supplied from the working machine hydraulic pump 9 to the lift cylinder 11A (step 102).

On the other hand, when all of the conditions a), b) and c) are satisfied (determined "Condition satisfied" in step 101), it is determined to be that the operation state is in one of the following and that it is necessary to limit the engine rotation speed N to the engine rotation speed upper limit value NLIM.

1) a state that the vehicle body 3 is stopped and the working machine 2 is not operated, 2) a state that the vehicle body 3 is stopped and the working machine 2 is solely operated only in the direction of lowering the lift, and 3) a state that the vehicle body 3 is stopped and the working machine 2 is solely operated only in the tilt direction.

The engine control means 40 limits the engine output torque to not more than the maximum torque value defined by the maximum torque line L, generates a control command to obtain the engine rotation speed N corresponding to the depressed amount of the accelerator pedal 25 with the engine rotation speed upper limit value NLIM as the rotation speed upper limit value, and outputs to the governor 35.

Therefore, for example, when the operator depresses the accelerator pedal 25 to the maximum opening and only the tilt operating means 613 among the working machine operating means 6 is operated to a full stroke in the forward or backward tilting direction while the vehicle body 3 is in a stopped state, matching occurs at the point P1 on the regulation line LLIM corresponding to the engine rotation speed upper limit value NLIM in FIG. 7, and the mast 4 can be forward tilted or backward tilted at the maximum speed.

This matching point P1 is a point where, as a result of performing the constant differential pressure control, the swash plate 9*c* of the working machine hydraulic pump 9 is adjusted and the capacity q of the working machine hydraulic pump 9 is controlled to a capacity q1.

At this time, the flow rate QT of the operating oil which is discharged from the working machine hydraulic pump 9 and supplied to the tilt cylinder 11B via the tilt control valve 10B is expressed by the following.

$$QT=q1\times NLIM \quad (2)$$

In FIG. 8, LN2 shows a relationship between an operation amount of the tilt operating means 6B and a flow rate Q of the operating oil discharged from the working machine hydraulic pump 9 and supplied to the tilt cylinder 11B via the tilt control valve 10B. When the tilt operating means 6B is operated for a full stroke, the flow rate QT shown in the above equation (2) is supplied from the working machine hydraulic pump 9 to the tilt cylinder 11B (step 103).

Differences in advantageous effects from conventional control not involving the control of this embodiment are described below.

That is, according to the conventional technology, when the operator similarly depresses the accelerator pedal 25 to the maximum opening and only the tilt operating means 6B among the working machine operating means 6 is operated to a full stroke in a forward tilting direction or a backward tilting direction while the vehicle body 3 is in a stopped state, matching occurs at the point P2 on the regulation line LH corresponding to the high idle rotation speed NH in FIG. 7.

This matching point P2 is a point where, as a result of performing the constant differential pressure control, the swash plate 9*c* of the working machine hydraulic pump 9 is adjusted and the capacity q of the working machine hydraulic pump 9 is controlled to a capacity q2. Here, the capacity q2 is a capacity smaller than the capacity q1 of the equation (2).

The flow rate QT of the operating oil which is discharged from the working machine hydraulic pump 9 and supplied to the tilt cylinder 11B via the tilt control valve 10B is expressed by the following.

$$QT=q2\times NH$$

As shown in FIG. 8, the maximum supply flow rate supplied from the working machine hydraulic pump 9 to the working machine hydraulic actuator 11 is set to the flow rate QL which is required to operate the lift cylinder 11A at the maximum speed in the direction of raising the lift.

On the other hand, in the case where only the tilt cylinder 11B is operated in the tilt direction, it is not necessary to discharge the maximum supply flow rate from the working machine hydraulic pump 9, and it is sufficient to have about 50% of the maximum supply capacity of the working machine hydraulic pump 9. That is, the tilt cylinder 11B is operated at the maximum speed in the tilt direction by about a half of the flow rate of the flow rate QL that is discharged when the lift cylinder 11A is operated at the maximum speed in the direction of raising the lift. Thus, the capacity q2 of the equation (3) becomes a value smaller than the capacity q0 of the equation (1).

FIG. 7 shows equal fuel consumption curves F1, F2 . . . Fi . . . in the same manner as in FIG. 1. The fuel consumption amount increases in order of F1<F2< . . . <Fi . . . .

When the conventional control is performed, matching occurs at a point P2 on the engine torque diagram where the pump capacity q is as small as q2, and the engine rotation speed N is as high as a high idle rotation speed NH. This matching point P2 is a point where the fuel consumption amount is large in view of the equal fuel consumption curve, and the engine rotation speed N is in a maximum range (high idle rotation speed NH). Hence, noise becomes large. In FIG. 7, LN indicates an equal horsepower curve of the engine 8 passing through the matching point P2. small to, high to, large to は意味不明

On the other hand, when the control of this embodiment is performed, matching occurs at the point P1 where the pump capacity q is as large as q1 and the engine rotation speed N is as low as an engine rotation speed upper limit value NLIM on the engine torque diagram. This matching point P1 is a point where the fuel consumption amount is small in view of the equal fuel consumption curve and the engine rotation speed N is lower than the high idle rotation speed NH, hence noise becomes small. And, the power of the engine 8 decreases, and the heat balance is improved.

The "state that the vehicle body 3 is stopped and the working machine 2 is solely operated only in the tilt direction" was described above. Similarly, in the "state that the vehicle body 3 is stopped and the working machine 2 is not operated" and the "state that the vehicle body 3 is stopped and the working machine 2 is solely operated only in the direction of lowering the lift", the engine rotation speed N is limited to the engine rotation speed upper limit value NLIM to suppress the fuel consumption and to reduce noise.

But, the above operation state such as described above is different from the "state that the vehicle body 3 is stopped and the working machine 2 is solely operated only in the tilt direction," and it is a state that does not need to supply the operating oil from the working machine hydraulic pump 9 to the working machine hydraulic actuator 11, and where it is not necessary to set the engine rotation speed N to an amount as large as the engine rotation speed upper limit value NLIM in order to secure the necessary flow rate.

Therefore, when the operating state is determined to be a state that it is unnecessary to supply the operating oil from the working machine hydraulic pump 9 to the working machine hydraulic actuator 11, such as the "state that the vehicle body 3 is stopped and the working machine 2 is not operated" or the "state that the vehicle body 3 is stopped and the working machine 2 is solely operated only in the direction of lowering the lift", it is also possible to set the engine rotation speed upper limit value to be lower than the engine rotation speed upper limit value NLIM in the state that it is necessary to supply the operating oil from the working machine hydraulic pump 9 to the working machine hydraulic actuator 11, such as the "state that the vehicle body 3 is stopped and the working machine 2 is solely operated only in the tilt direction." Second control is described below.

(Second Control)

According to the second control, when it the operation state is determined to be:

1) a state that the vehicle body 3 is stopped and the working machine 2 is not operated, or
2) a state that the vehicle body 3 is stopped and the working machine 2 is solely operated only in the direction of lowering the lift, the engine rotation speed upper limit value setting means 39 sets the upper limit value of the engine rotation speed N to a rotation speed, lower than the engine rotation speed upper limit value NLIM, for example, a low-idle rotation speed NL.

And, when it is determined to be:

3) a state that the vehicle body 3 is stopped and the working machine 2 is solely operated only in the tilt direction, the upper limit value of the engine rotation speed N is set to the engine rotation speed upper limit value NLIM.

A procedure of processing the second control is shown in FIG. 10. According to the second control, the processing is performed by the controller 30 according to the flow chart shown in FIG. 10.

Specifically, similar to step 101 in FIG. 9, the determining means 38 in the controller 30 determines whether or not all of the following conditions are satisfied (step 201):

a) the traveling direction indicating means 13 is in a neutral position N, b) the lift raising switch 28 is off (the lift operating means 6A is not operated in the direction of raising the lift), and c) the first, second and third attachment switches 31, 32 and 33 are off (the first, second and third attachment operating means 6C, 6D and 6E are not operated), When at least one of the conditions a), b) and c) is not satisfied (determined "Condition not satisfied" in step 201), it is determined that the operation state does not need to limit the engine rotation speed N to a rotation speed lower than the high idle rotation speed NH, and the engine control means 40 limits the engine output torque to not more than the maximum torque value defined by the maximum torque line L, generates a control command to obtain an engine rotation speed N corresponding to the depressed amount of the accelerator pedal 25 with the high idle rotation speed NH as the rotation speed upper limit value, and outputs to the governor 35. Therefore, as shown in FIG. 7, for example, matching is made at the point P0 on the regulation line LH corresponding to the high idle rotation speed NH, for example, and a heavy cargo can be lifted by the fork 5 at the maximum speed (step 202).

On the other hand, when all of the conditions a), b) and c) are satisfied (determined in step 201; to be "Condition satisfied" in step 201), it is further determined whether or not the following condition is satisfied (step 203):

d) the forward and backward tilt switch 29 is off (the tilt operating means 6B is not operated in the forward tilting direction or the backward tilting direction).

When the condition d) is not established (determined "Condition not satisfied" in step 203), it is determined as 3) a state that the vehicle body 3 is stopped and the working machine 2 is solely operated only in the tilt direction, and that it is necessary to limit the engine rotation speed N to the engine rotation speed upper limit value NLIM, and the engine control means 40 limits the engine output torque to not more than the maximum torque value defined by the maximum torque line L, generates a control command to obtain an engine rotation speed N corresponding to the depressed amount of the accelerator pedal 25 with the engine rotation speed upper limit value NLIM as the rotation speed upper limit value, and outputs to the governor 35. Therefore, for example, matching occurs at the point P1 on the regulation line LLIM corresponding to the engine rotation speed upper limit value NLIM in FIG. 7, for example, and the mast 4 can be forward tilted or backward tilted at the maximum speed (step 204).

On the other hand, in the case where the condition d) is satisfied (determined "Condition satisfied" in step 203), it is determined that the operation is in one of:

1) a state that the vehicle body 3 is stopped and the working machine 2 is not operated, and 2) a state that the vehicle body 3 is stopped and the working machine 2 is solely operated only in the direction of lowering the lift, and that it is necessary to limit the engine rotation speed N to the low-idle rotation speed NL, and the engine control means 40 limits the engine output torque to not more than the maximum torque value defined by the maximum torque line L, generates a control command to change the engine rotation speed N to be the low-idle rotation speed NL regardless of the depressed amount of the accelerator pedal 25, and outputs to the governor 35. Therefore, as shown in FIG. 7, matching can be made at the point P3 on a regulation line LL corresponding to the low-idle rotation speed NL (step 205).

According to the above second control similar to the first control, the fuel consumption is suppressed, the noise is reduced, and the heat balance is improved. In addition, when the operation is in a state that it is not necessary to supply the operating oil from the working machine hydraulic pump 9 to the working machine hydraulic actuator 11, the engine rotation speed N is limited to the low-idle rotation speed NL regardless of the accelerator opening. Thus, useless idling of the engine can be suppressed, and suppression of the fuel consumption and noise reduction are further promoted.

FIG. 4 shows the forward and backward tilt switch 29, but, when the first control is performed, the forward and backward tilt switch 29 can be omitted.

The vehicle body stop detecting means 36 in the above-described embodiment is designed to detect, according to the detection signal of the FR switch 27, that the vehicle body 3 is stopped, but it may also detect, according to the detection signal of the braking detecting means 35, that the vehicle body 3 is stopped. For example, when the depressed amount of the brake pedal (inching pedal) 26 becomes not less than a prescribed threshold value, it detects that the vehicle body 3 is stopped.

It was described in the above embodiment that constant differential pressure control is performed assuming that the working machine hydraulic pump 9 is a variable displacement type hydraulic pump.

But, when the working machine hydraulic pump 9 is a fixed displacement type hydraulic pump and the constant differential pressure control is not performed, the present invention can also be applied in the same manner.

Effects of the invention in this case are described with reference to FIG. 8.

According to the conventional control, when the single tilt operation was performed, about 50% of the oil quantity QL, which was supplied from the working machine hydraulic pump 9 to the tilt control valve 10B, namely a difference QL-QT from the necessary flow rate QT, was determined to return as an excess flow rate to the tank 43. Thus, the pressure of the operating oil which was not supplied to the tilt cylinder 11B by the tilt control valve 10B was raised uselessly, resulting in the oil temperature increase, the engine power loss and the increase in fuel consumption amount.

On the other hand, according to the present invention, in the case of 3) a state that the vehicle body 3 is stopped and the working machine 2 is solely operated only in the tilt direction, the engine rotation speed N is limited to the engine rotation speed upper limit value NLIM, and, consequently, the oil quantity supplied from the working machine hydraulic pump 9 to the tilt control valve 10B is decreased from the oil quantity QL of the conventional control to a lower oil quantity, for example, exactly a necessary flow rate QT. As a result, the oil temperature is decreased, the engine power loss is suppressed, the fuel consumption amount is suppressed, and the noise ris reduced.

And also similarly, when the operation state is 1) a state that the vehicle body 3 is stopped and the working machine 2 is not operated, or 2) a state that the vehicle body 3 is stopped and the working machine 2 is solely operated only in the direction of lowering the lift, the engine rotation speed N is limited to the engine rotation speed upper limit value NLIM or lower, for example, to the low-idle rotation speed NL. Therefore, the operating oil is not discharged uselessly from the working machine hydraulic pump 8, the oil temperature is decreased, the engine power loss is suppressed, the fuel consumption amount is suppressed and the noise is reduced, and furthermore, it becomes possible to suppress useless idling of the engine 8.

Figure 1:
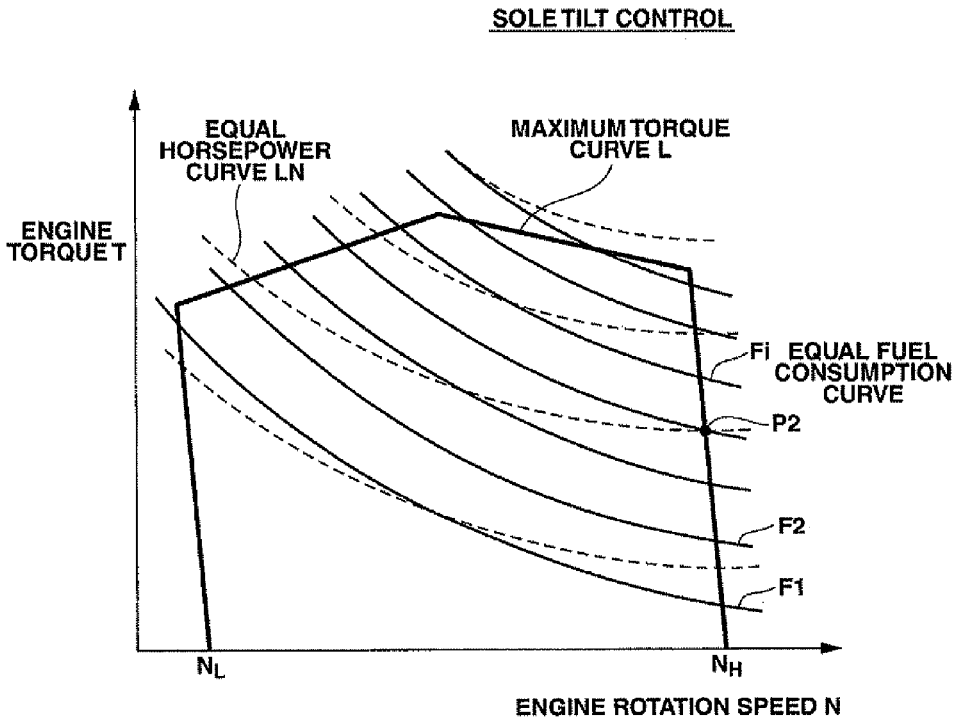
FIG.1 PRIOR ART
FIG. 1 is a view to explain conventional technology, showing an engine torque diagram.
Figure 2:
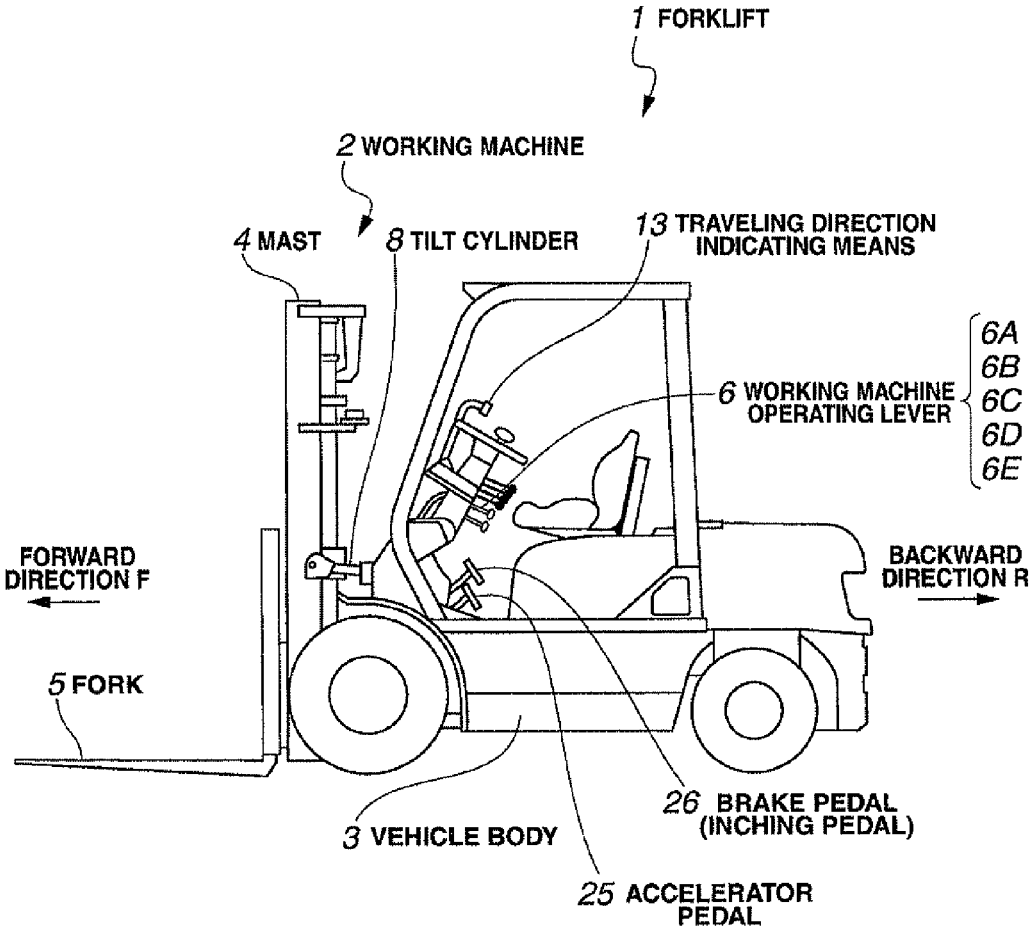
FIG. 2 is a side view of a forklift body, which is shown to illustrate a structure of a working machine of the forklift.
Figure 3:
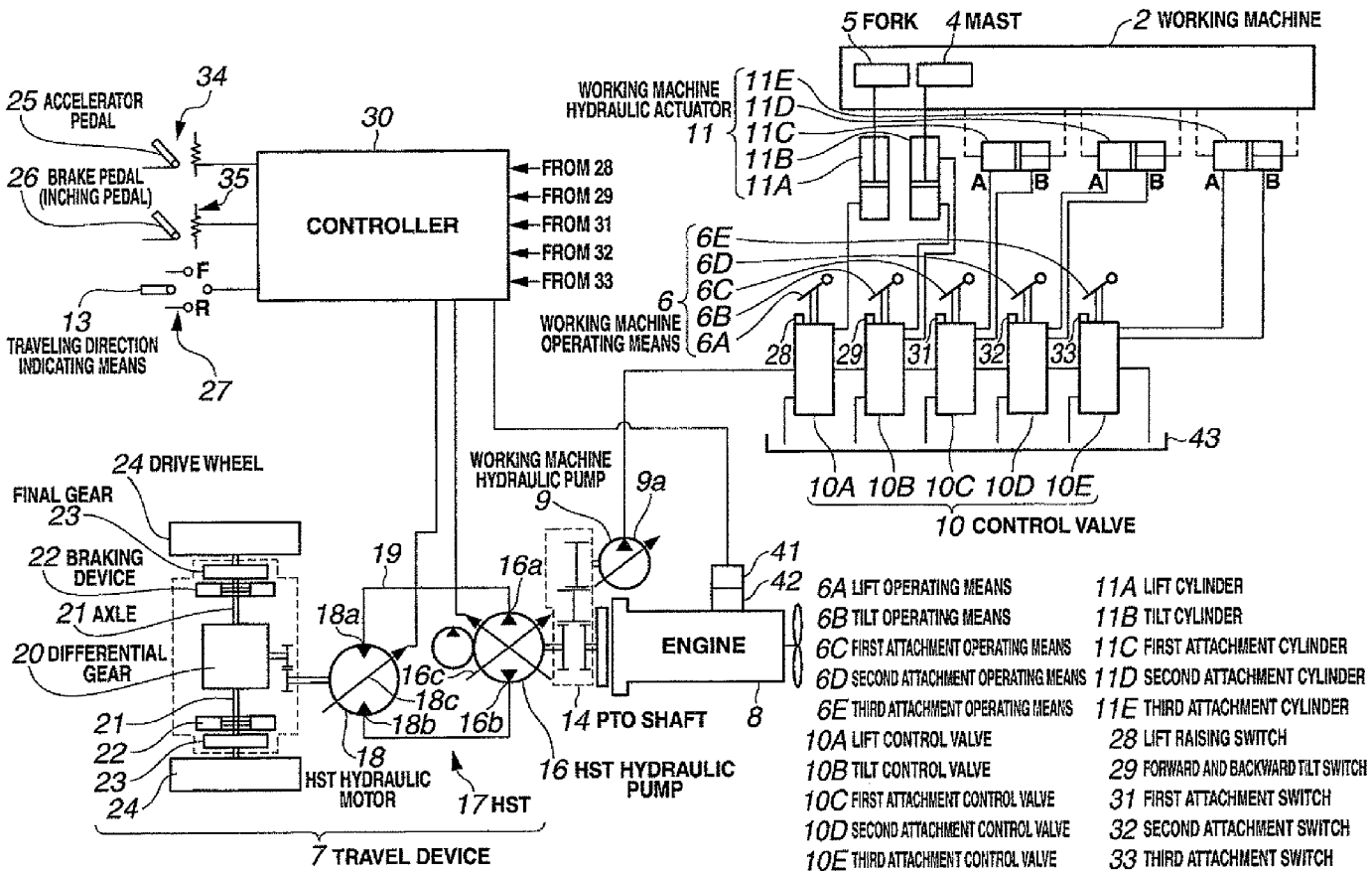
FIG. 3 is a view showing a structure of a power transmission system of the forklift of an embodiment.
Figure 4:
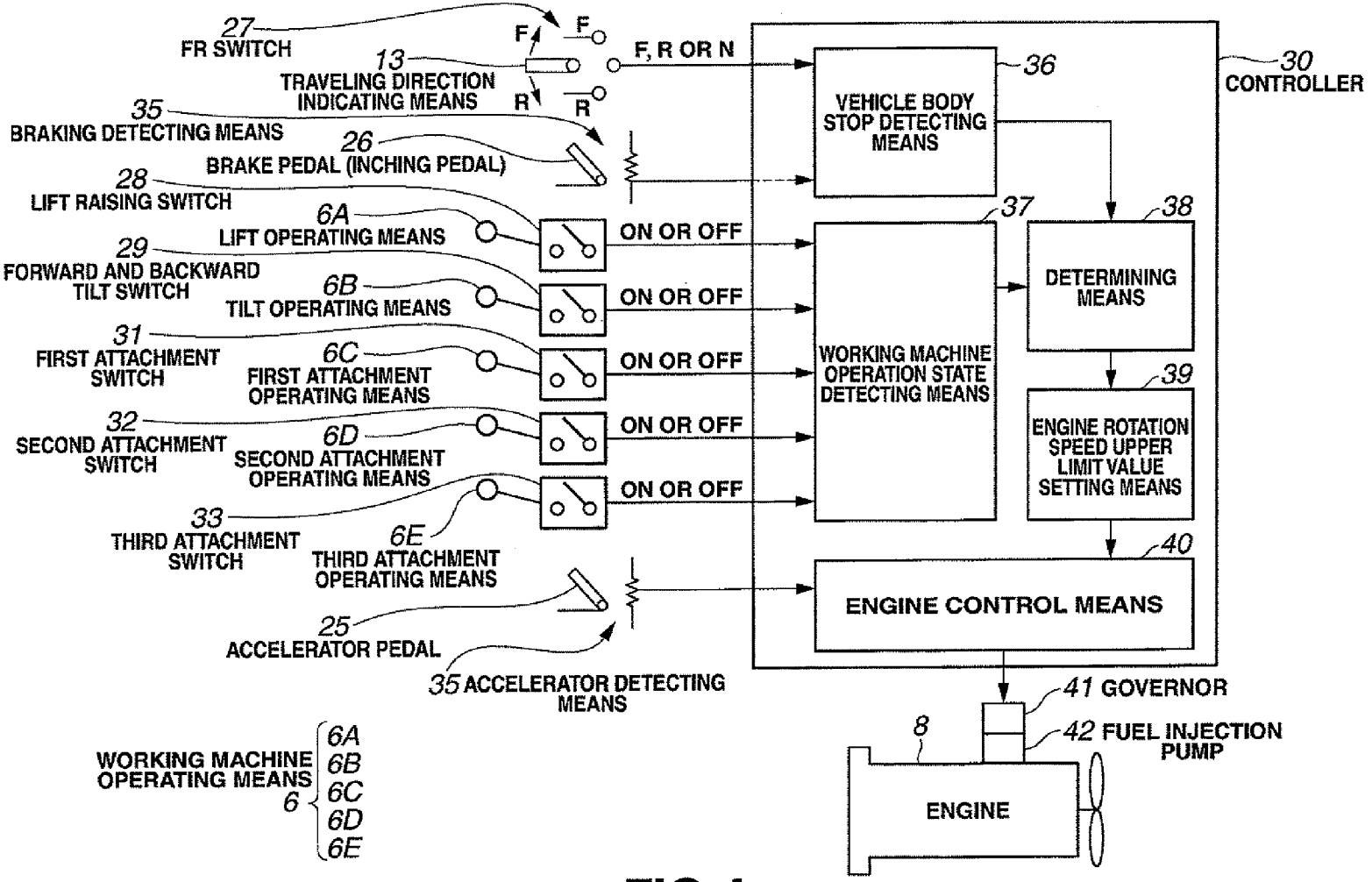
FIG. 4 is a view showing a structure of a control system of the forklift.
Figure 5A:
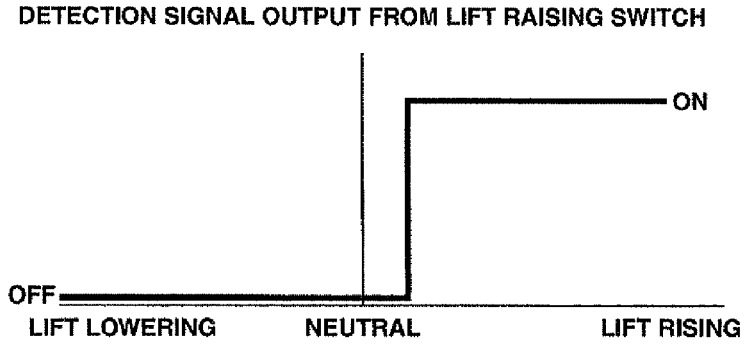
FIG. 5A is a diagram showing a detection signal output from a lift raising switch.
Figure 5B:
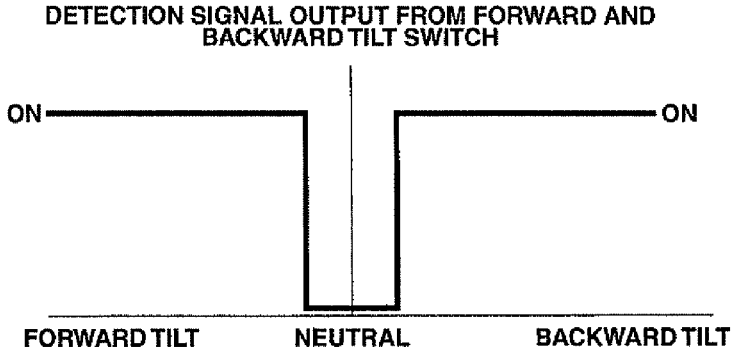
FIG. 5B is a diagram showing a detection signal output from a forward and backward tilt switch.
Figure 5C:
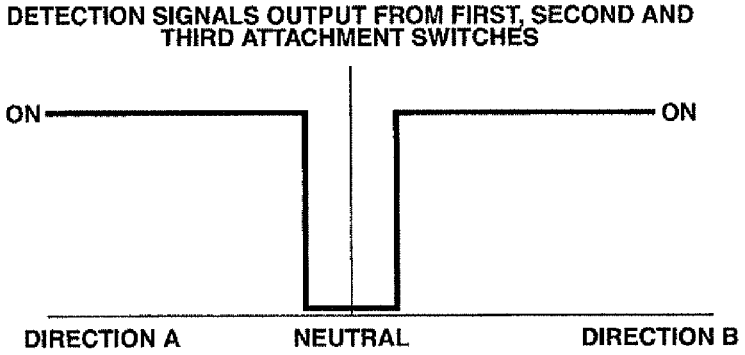
FIG. 5C is a diagram showing a detection signal output from first, second and third attachment switches.
Figure 6:
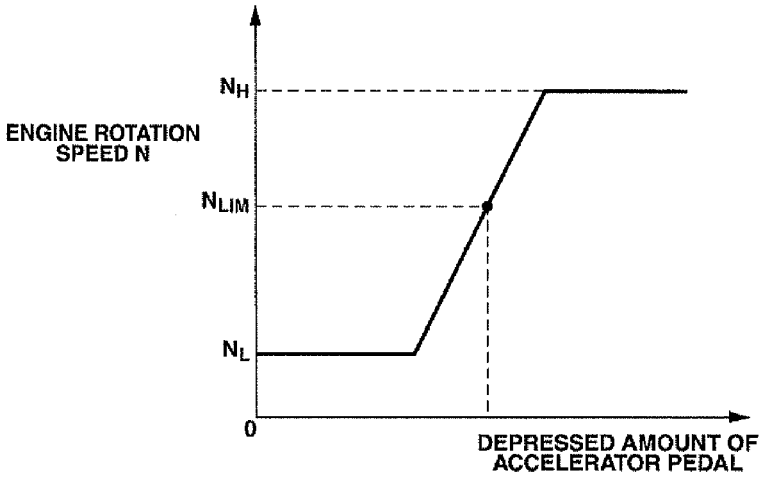
FIG. 6 is a diagram showing a relationship between a depressed amount of an accelerator pedal and an engine rotation speed.
Figure 7:
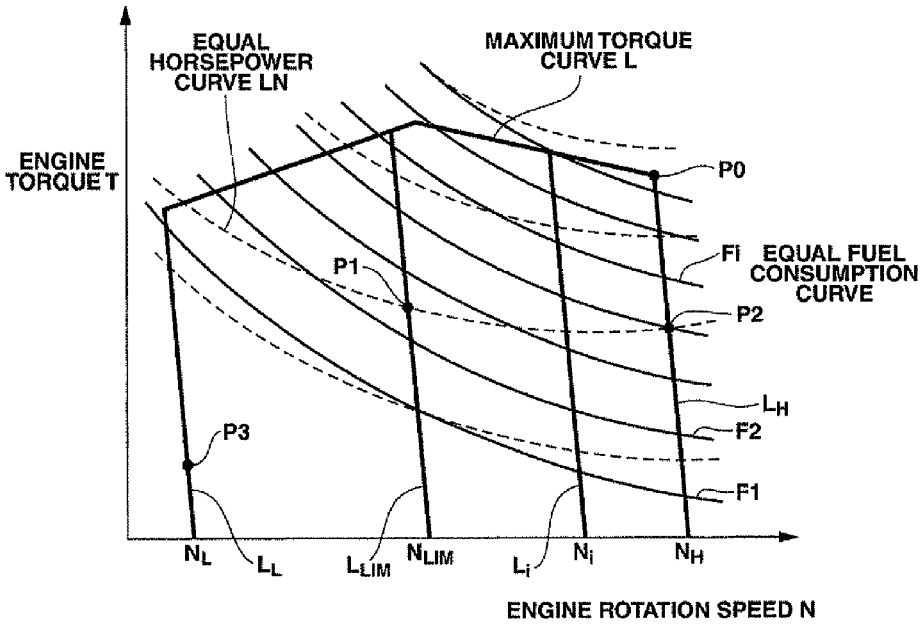
FIG. 7 is an engine torque diagram of an embodiment.
Figure 8:
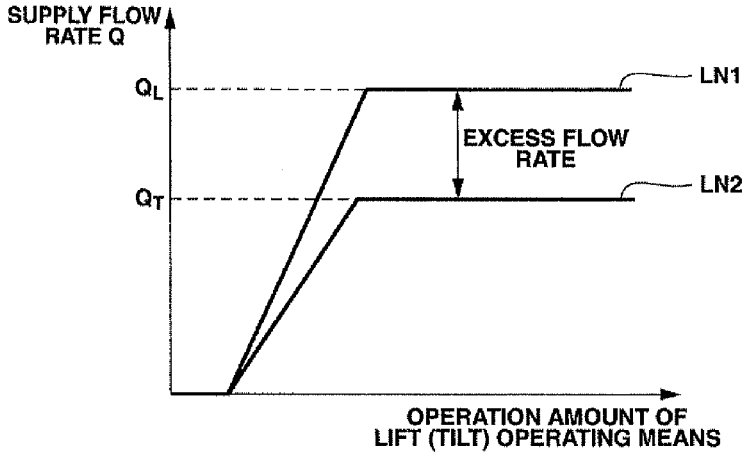
FIG. 8 is a diagram showing a relationship between an operation amount of a lift operating means and a flow rate of the operating oil which is discharged from a working machine hydraulic pump and supplied to a lift cylinder via a lift control valve and a relationship between an operation amount of a tilt operating means and a flow rate of the operating oil which is discharged from working machine hydraulic pump and supplied to a tilt cylinder via a tilt control valve.
Figure 9:
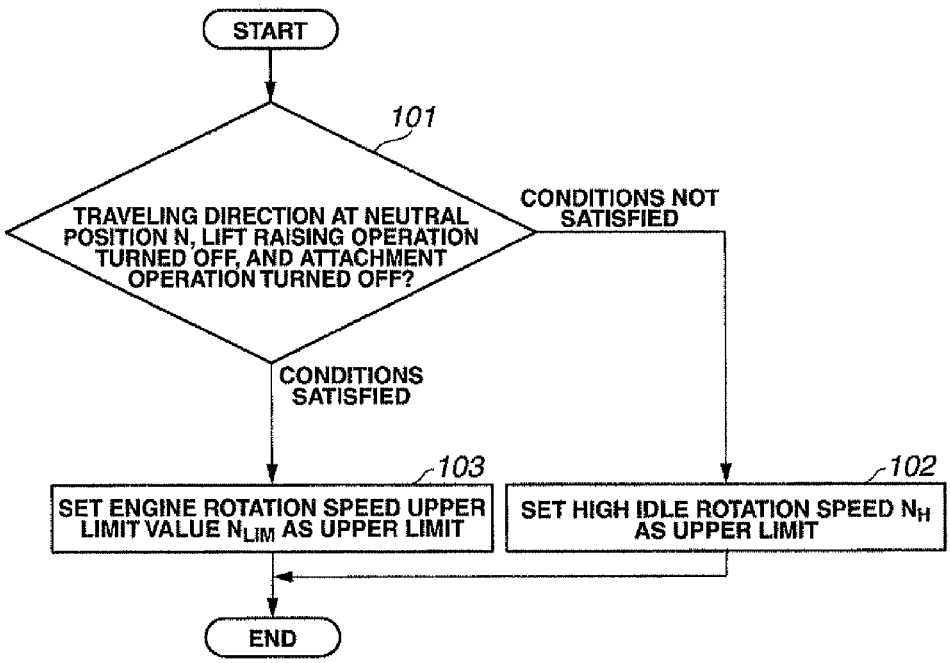
FIG. 9 is a flow chart showing a procedure of processing for first control.
Figure 10:
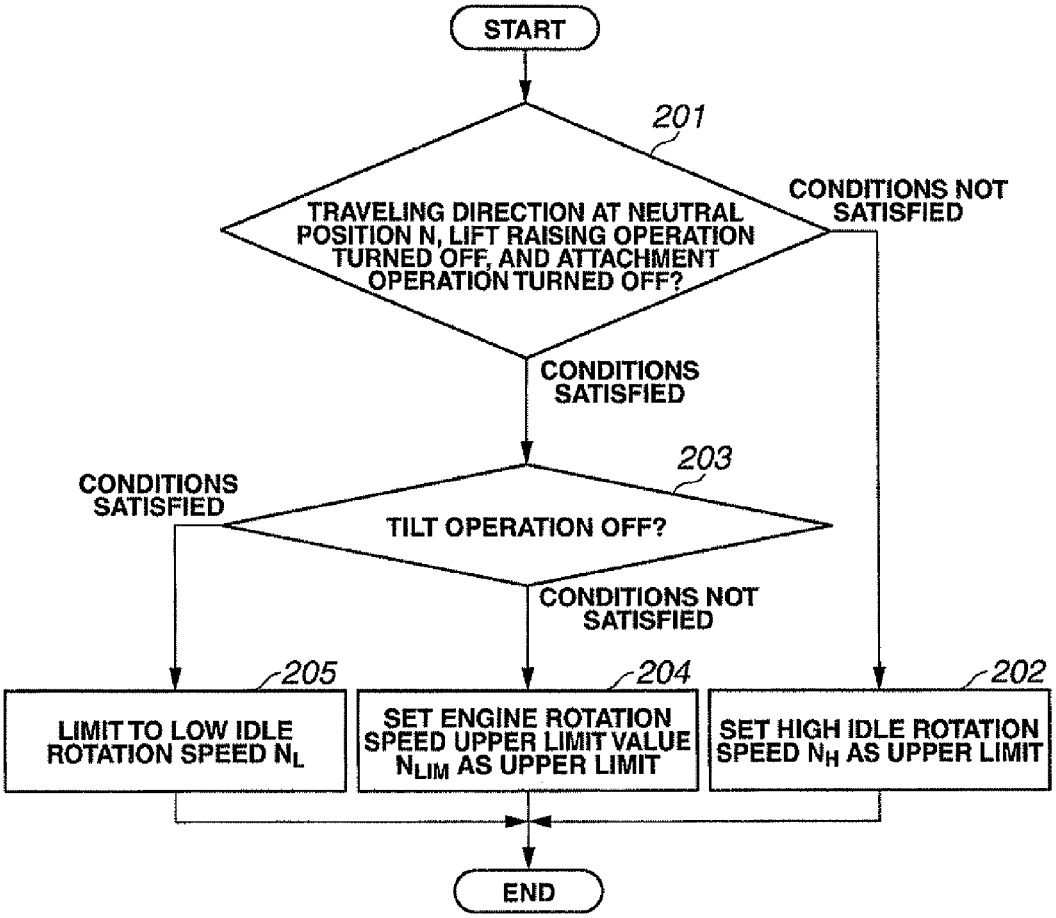
FIG. 10 is a flow chart showing a procedure of processing for second control.

The invention claimed is:

1. An engine control device for a forklift, which is provided with a travel device driven by an engine and a working machine operated by receiving supply of a pressure oil discharged from a working machine hydraulic pump with the engine used as a drive source, and also provided with a working machine operating device that is configured to operate the working machine according to operation, which is operated in the direction of raising a lift by operating the working machine operating device in the direction of raising the lift and operated in a tilt direction by operating the working machine operating device in a tilt operation direction, and a controller that is configured to control the engine to have an engine rotation speed according to the operation of an accelerator with a high idle speed determined as a first upper limit value, wherein, the controller is configured to:

detect that a vehicle body is stopped;

detect an operation state of the working machine operating device;

determine on the basis of detection results that the vehicle body is stopped and the working machine is solely operated only in the direction of lowering the lift, or the vehicle body is stopped and the working machine is solely operated only in the tilt direction;

set a second upper limit value of the engine rotation speed to a rotation speed lower than the high idle speed when it is determined that the vehicle body is stopped and the working machine is solely operated only in the direction of lowering the lift, or the vehicle body is stopped and the working machine is solely operated only in the tilt direction, and control the engine to have the engine rotation speed according to the operation of the accelerator with the second upper limit value as an upper limit value of the engine rotation speed.

2. The engine control device for a forklift according to claim 1, wherein:

when it is determined that the vehicle body is stopped and the working machine is solely operated only in the tilt direction, the controller determines the second upper limit value of the engine rotation speed to be an engine rotation speed at which an oil quantity supplied to the working machine becomes an oil quantity required for the tilt operation of the working machine.

3. The engine control device for a forklift according to claim 1, wherein:

the working machine hydraulic pump is a variable displacement type hydraulic pump, the pressure oil is supplied from the working machine hydraulic pump to the working machine via a tilt control valve to perform so that the working machine performs a tilt operation, and a capacity of the working machine hydraulic pump is controlled so that a pressure difference before and after the tilt control valve becomes a constant value.

4. The engine control device for a forklift according to claim 1, wherein the controller detects that the vehicle body is stopped when a traveling direction of the vehicle body is positioned in a neutral position.

5. The engine control device for a forklift according to claim 1, wherein:

the working machine operating device comprises a lift operating device that operates the working machine in the direction of raising the lift, a tilt operating device that operates the working machine in the tilt direction, and an attachment operating device that operates the working machine in a direction according to an attachment;

the controller detects that the lift operating device is not operated in the direction of raising the lift and the attachment operating device is not operated, and when it is detected that the vehicle body is stopped, and when it is detected that the lift operating device is not operated in the direction of raising the lift and that the attachment operating device is not operated, the controller determines that the vehicle body is stopped and the working machine is solely operated only in the direction of lowering the lift, or the vehicle body is stopped and the working machine is solely operated only in the tilt direction.

6. The engine control device for a forklift according to claim 2, wherein:

the working machine hydraulic pump is a variable displacement type hydraulic pump, the pressure oil is supplied from the working machine hydraulic pump to the working machine via a tilt control valve to perform so that the working machine performs a tilt operation, and a capacity of the working machine hydraulic pump is controlled so that a pressure difference before and after the tilt control valve becomes a constant value.

7. The engine control device for a forklift according to claim 2, wherein the controller detects that the vehicle body is stopped when a traveling direction of the vehicle body according to the operation is positioned in a neutral position.

8. The engine control device for a forklift according to claim 3, wherein the controller detects that the vehicle body is stopped when a traveling direction of the vehicle body according to the operation is positioned in a neutral position.

9. The engine control device for a forklift according to claim 6, wherein the controller detects that the vehicle body is stopped when a traveling direction of the vehicle body according to the operation is positioned in a neutral position.

10. The engine control device for a forklift according to claim 2, wherein:

the working machine operating device comprises a lift operating device that operates the working machine in the direction of raising the lift, a tilt operating device that operates the working machine in the tilt direction, and an attachment operating device that operates the working machine in a direction according to an attachment;

the controller detects that the lift operating device is not operated in the direction of raising the lift and the attachment operating device is not operated, and when it is detected that the vehicle body is stopped, and when it is detected that the lift operating device is not operated in the direction of raising the lift and that the attachment operating device is not operated, the controller determines that the vehicle body is stopped and the working machine is solely operated only in the direction of lowering the lift, or the vehicle body is stopped and the working machine is solely operated only in the tilt direction.

11. The engine control device for a forklift according to claim 3, wherein:

the working machine operating device comprises a lift operating device that operates the working machine in the direction of raising the lift, a tilt operating device that operates the working machine in the tilt direction, and an attachment operating device that operates the working machine in a direction according to an attachment;

the controller detects that the lift operating device is not operated in the direction of raising the lift and the attachment operating device is not operated, and when it is detected that the vehicle body is stopped, and when it is detected that the lift operating device is not operated in the direction of raising the lift and that the attachment operating device is not operated, the controller determines that the vehicle body is stopped and the working machine is solely operated only in the direction of lowering the lift, or the vehicle body is stopped and the working machine is solely operated only in the tilt direction.

12. The engine control device for a forklift according to claim 6, wherein:

the working machine operating device comprises a lift operating device that operates the working machine in the direction of raising the lift, a tilt operating device that operates the working machine in the tilt direction, and an attachment operating device that operates the working machine in a direction according to an attachment;

the controller detects that the lift operating device is not operated in the direction of raising the lift and the attachment operating device is not operated, and when it is detected that the vehicle body is stopped, and when it is detected that the lift operating device is not operated in the direction of raising the lift and that the attachment operating device is not operated, the controller determines that the vehicle body is stopped and the working machine is solely operated only in the direction of lowering the lift, or the vehicle body is stopped and the working machine is solely operated only in the tilt direction.

13. The engine control device for a forklift according to claim 4, wherein:

the working machine operating device comprises a lift operating device that operates the working machine in the direction of raising the lift, a tilt operating device that operates the working machine in the tilt direction, and an attachment operating device that operates the working machine in a direction according to an attachment;

the controller detects that the lift operating device is not operated in the direction of raising the lift and the attachment operating device is not operated, and when it is detected that the vehicle body is stopped, and when it is detected that the lift operating device is not operated in the direction of raising the lift and that the attachment operating device is not operated, the controller determines that the vehicle body is stopped and the working machine is solely operated only in the direction of lowering the lift, or the vehicle body is stopped and the working machine is solely operated only in the tilt direction.

14. The engine control device for a forklift according to claim 7, wherein:

the working machine operating device comprises a lift operating device that operates the working machine in the direction of raising the lift, a tilt operating device that operates the working machine in the tilt direction, and an attachment operating device that operates the working machine in a direction according to an attachment;

the controller detects that the lift operating device is not operated in the direction of raising the lift and the attachment operating device is not operated, and when it is detected that the vehicle body is stopped, and when it is detected that the lift operating device is not operated in the direction of raising the lift and that the attachment operating device is not operated, the controller determines that the vehicle body is stopped and the working machine is solely operated only in the direction of lowering the lift, or the vehicle body is stopped and the working machine is solely operated only in the tilt direction.

15. The engine control device for a forklift according to claim 8, wherein:

the working machine operating device comprises a lift operating device that operates the working machine in the direction of raising the lift, a tilt operating device that operates the working machine in the tilt direction, and an attachment operating device that operates the working machine in a direction according to an attachment;

the controller detects that the lift operating device is not operated in the direction of raising the lift and the attachment operating device is not operated, and when it is detected that the vehicle body is stopped, and when it is detected that the lift operating device is not operated in the direction of raising the lift and that the attachment operating device is not operated, the controller determines that the vehicle body is stopped and the working machine is solely operated only in the direction of lowering the lift, or the vehicle body is stopped and the working machine is solely operated only in the tilt direction.

16. The engine control device for a forklift according to claim 9, wherein:

the working machine operating device comprises a lift operating device that operates the working machine in the direction of raising the lift, a tilt operating device that operates the working machine in the tilt direction, and an attachment operating device that operates the working machine in a direction according to an attachment;

the controller detects that the lift operating device is not operated in the direction of raising the lift and the attachment operating device is not operated, and when it is detected that the vehicle body is stopped, and when it is detected that the lift operating device is not operated in the direction of raising the lift and that the attachment operating device is not operated, the controller determines that the vehicle body is stopped and the working machine is solely operated only in the direction of lowering the lift, or the vehicle body is stopped and the working machine is solely operated only in the tilt direction.

17. The engine control device for a forklift according to claim 1, wherein:

the controller further determines that the vehicle body is stopped and the working machine is not operated, and the controller sets the second upper limit value of the engine rotation speed to the rotation speed lower than the high idle speed when it is determined that i) the vehicle body is stopped and the working machine is not operated, and ii) the vehicle body is stopped and the working machine is solely operated only in the direction of lowering the lift, or the vehicle body is stopped and the working machine is solely operated only in the tilt direction.

* * * * *